US008082852B2

(12) United States Patent
Plyler et al.

(10) Patent No.: US 8,082,852 B2
(45) Date of Patent: Dec. 27, 2011

(54) SYSTEM AND METHOD FOR RAILROAD TRACK TIE PLATE ORIENTATION

(75) Inventors: Mark Plyler, Notasulga, AL (US); Andy Loftis, Pike Road, AL (US); John Cook, Birmingham, AL (US); Dennis Grantham, Elmore, AL (US); Michael Adams, Alexander City, AL (US)

(73) Assignee: Progress Rail Services Corp, Albertville, AL (US)

( * ) Notice: Subject to any disclaimer, the term of this patent is extended or adjusted under 35 U.S.C. 154(b) by 84 days.

(21) Appl. No.: 12/642,228

(22) Filed: Dec. 18, 2009

(65) Prior Publication Data

US 2011/0146527 A1 Jun. 23, 2011

(51) Int. Cl.
*E01B 3/00* (2006.01)

(52) U.S. Cl. ..... 104/16; 104/2; 104/17.1; 104/17.2

(58) Field of Classification Search ..... 104/2, 8, 104/9, 16, 17.1, 17.2
See application file for complete search history.

(56) References Cited

U.S. PATENT DOCUMENTS

| | | | | | |
|---|---|---|---|---|---|
| 3,943,858 | A * | 3/1976 | Dieringer et al. | ..... | 104/16 |
| 4,225,429 | A | 9/1980 | Holley | | |
| 4,241,663 | A | 12/1980 | Lund et al. | | |
| 4,280,613 | A | 7/1981 | Stewart | | |
| 4,691,639 | A | 9/1987 | Holley | | |
| 4,727,989 | A * | 3/1988 | Cotic et al. | ..... | 209/546 |
| 4,819,784 | A | 4/1989 | Sticht | | |
| 4,907,686 | A * | 3/1990 | Cotic | ..... | 193/45 |
| 4,909,375 | A | 3/1990 | Cotic et al. | | |
| 4,942,822 | A * | 7/1990 | Cotic | ..... | 104/16 |
| 4,974,518 | A * | 12/1990 | Cotic et al. | ..... | 104/16 |
| 5,038,914 | A | 8/1991 | Cotic et al. | | |
| 5,063,856 | A | 11/1991 | Theurer et al. | | |
| 5,067,412 | A | 11/1991 | Theurer et al. | | |
| 5,074,219 | A | 12/1991 | Theurer et al. | | |
| 5,331,899 | A | 7/1994 | Holley | | |
| 5,655,455 | A | 8/1997 | Smith | | |
| 5,961,055 | A | 10/1999 | Lehtinen | | |
| 6,167,607 | B1 | 1/2001 | Pryor | | |
| 6,595,140 | B1 | 7/2003 | Madison et al. | | |
| 6,807,909 | B1 * | 10/2004 | Coots | ..... | 104/16 |
| 6,974,097 | B2 | 12/2005 | Simon et al. | | |
| 7,097,029 | B2 | 8/2006 | Halang | | |
| 7,243,777 | B2 | 7/2007 | Reznik et al. | | |
| 7,827,916 | B2 * | 11/2010 | Coots, Jr. | ..... | 104/16 |
| 2009/0133598 | A1 | 5/2009 | Coots | | |

* cited by examiner

*Primary Examiner* — Joe Morano, IV
*Assistant Examiner* — Jason C Smith
(74) *Attorney, Agent, or Firm* — Leydig, Voit & Mayer, Ltd

(57) ABSTRACT

A machine for automatically orienting railroad tie plates includes a sensing region having at least one optical sensor adapted to sense a physical feature of a tie plate. An electronic controller is connected to the optical sensor and is disposed to receive a sensor signal indicative of the physical feature of the tie plate when the tie plate is in the sensing region. The electronic controller further determines an orientation of the tie plate based on the sensor signal, compares it to one or more predetermined or possible orientations, and provides a command to at least one actuator adapted to perform at least one tie plate orientation operation to change the orientation of the tie plate based on the comparison of the orientation of the plate with the predetermined orientation.

18 Claims, 6 Drawing Sheets

SYSTEM AND METHOD FOR RAILROAD TRACK TIE PLATE ORIENTATION

TECHNICAL FIELD

This patent disclosure relates generally to railroad track construction, maintenance, and service equipment and, more particularly, equipment for sorting and orienting tie plates that are retrieved from a rail bed before being placed between a rail and rail ties.

BACKGROUND

Equipment for mechanically placing tie plates between rails and rail ties has been proposed in the past. One example of a proposed tie plate placer machine can be found in U.S. Pat. No. 5,655,455 ("the '455 patent"). The tie plate placer disclosed in the '455 patent includes a mobile frame travelling on a railroad track that collects loose tie plates from the rail bed and places them in a magazine for holding and for later positioning on a selected rail tie and underneath the rail. A rail jack lifts the rail away from the tie to allow insertion of the tie plate, and an insertion arm and plate urge a tie plate from the magazine into position between the tie and the rail.

In the device disclosed in the '455 patent, tie plates are retrieved from the rail bed and stored in a collection bed. Operators manipulating magnetic frames sort and orient the collected tie plates into magazines, which are associated with the mechanism that places the tie plates between the rail and the rail ties. Such manipulation of tie plates is susceptible to operator error, and, in part because it requires a dedicated operator for each side of the track during operation, it has an increased cost of operation.

Another example of a known automated tie plate orientation sensor arrangement and a known tie plate sorting and orientation device are shown, respectively, in U.S. Pat. Nos. 4,727,989 ("the '989 patent") and U.S. Pat. No. 4,907,686 ("the '686 patent"). The device disclosed in the '989 patent is used for determining the current orientation of tie plates using a series of spaced fingers that are pivotable relative to a bar and are arranged across a conveyor carrying the tie plates. Contact between the tie plates and the fingers causes pivotal displacement of the fingers, which act as whiskers to determine the contour and, thus, the orientation of the plates carried by the conveyor. When re-orienting the plates, the device disclosed in the '686 patent includes an inclined conveyor having devices that arrest the descent of individual tie plates along the conveyor. Actuators then flip each tie plate to a correct orientation.

Such and other proposed devices for sensing the orientation of tie plates, whether operating in a manual or automatic fashion, are time consuming and/or involve complicated mechanisms that can be unreliable, inaccurate, costly, and/or inefficient to operate when sorting and orienting tie plates at a high rate for prolonged periods or in inclement weather conditions.

SUMMARY

In one aspect, the disclosure describes a machine for automatically orienting railroad tie plates that includes a sensing region having at least one optical sensor adapted to sense a physical feature of a tie plate. An electronic controller is connected to the optical sensor and is disposed to receive a sensor signal indicative of the physical feature of the tie plate when the tie plate is in the sensing region. The electronic controller further determines an orientation of the tie plate based on the sensor signal, compares it to one or more predetermined or possible orientations, and provides a command to at least one actuator adapted to perform at least one tie plate orientation operation to change the orientation of the tie plate based on the comparison of the orientation of the plate with the predetermined orientation.

In another aspect, the disclosure describes a machine for placing tie plates between rails and rail ties in a railroad. The machine includes a tie plate depositor and a tie plate collector arranged to collect individual tie plates strewn along a rail bed. A machine frame includes wheels riding on the railroad, an engine arranged to power the wheels, and an operator cab. A sorting and orientation portion of the machine includes at least one plate orientation actuator, a sensing region, and a conveyor system extending between the collector, the sensing region, the sorting and orientation portion, and the tie plate depositor. At least one optical sensor is associated with the sensing region and is connected to the machine. The at least one optical sensor is adapted to sense a physical feature of at least one tie plate passing through the sensing region while transported by the conveyor system. An electronic controller receives a sensor signal indicative of the physical feature of a tie plate as it passes through the sensing region. The electronic controller is arranged to determine an orientation of the tie plate based on the sensor signal, designate one of four predetermined orientations to each tie plate that passes through the sensing region, and provide a command signal to the at least one plate orientation actuator to change the orientation of the tie plate based on the designated predetermined orientation before the tie plate is provided to the tie plate depositor by the conveyor system.

In yet another aspect, the disclosure describes a method for automatically sorting and orienting tie plates in a tie plate placing machine. The method includes sensing at least one physical feature of each tie plate by scanning a portion thereof with an optical sensor. A signal indicative of the physical feature is provided to an electronic controller that determines an orientation of each tie plate based on the signal. The orientation of each tie plate is compared to one or more possible, predetermined orientations, and an orientation designation is assigned to each tie plate. Each plate is thereafter re-oriented based on the orientation designation.

DETAILED DESCRIPTION

This disclosure relates to machines and equipment for use during installation, replacement, service, and/or maintenance of railroad tracks. Routine maintenance of a railroad track includes replacement of certain railroad ties. Railroad tie replacement can include various operations, such as removing spikes that secure the tie plates to the cross ties, replacing the cross ties beneath the rail, and retrieving and reinstalling the tie plates, which have typically been strewn on the rail bed beside the track during the removal phase. Machines and devices for removing and reinstalling spikes and cross ties, as well as machines for collecting tie plates strewn on the rail bed along the track, but the inventors herein know of no commercially successful machines that are known to be currently on the market. The present disclosure relates to a system and method for automatically sorting, checking, and/or orienting tie plates collected from the rail bed for proper orientation during rail installation or re-installation. The embodiments described herein are presented as part of a fully automated machine that can travel along a railroad track while collecting, sorting, and installing tie plates. Although such a machine is useful in railroad track maintenance and installation, other applications are well suited for the systems and methods disclosed. For example, a machine of a different type, or a static installation used for sorting and loading loose tie plates into magazines or other containers, may benefit from the disclosed systems and/or methods.

Figure 1:
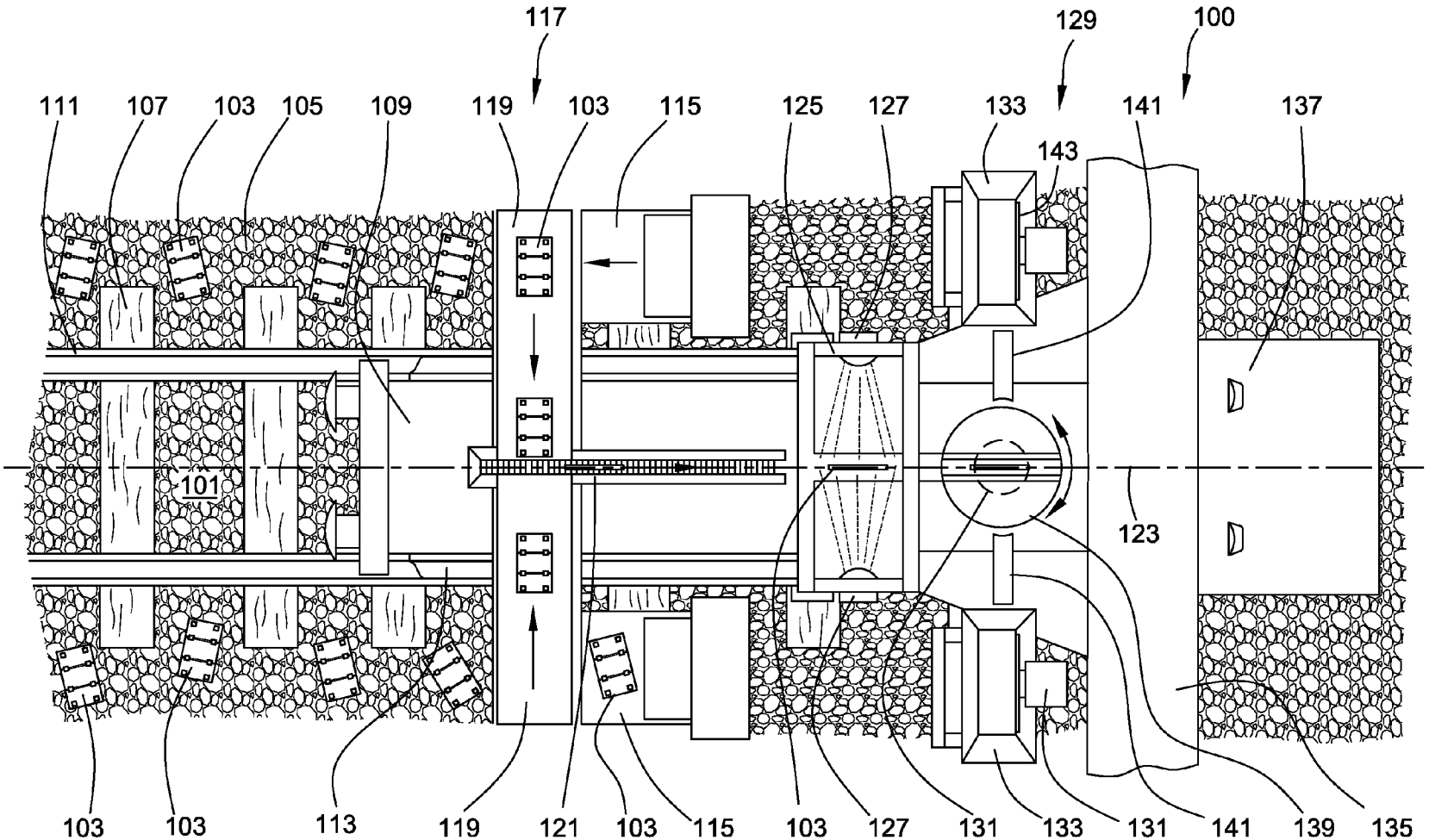
FIG. 1 is an outline view from a top perspective of a tie placer machine in accordance with the disclosure.

A partial view of a tie placing machine 100 from a top perspective during operation along a railroad track 101 is shown in FIG. 1. The tie placing machine 100 is capable of collecting tie plates 103 that are strewn on the rail bed 105 along the railroad track 101 after they have been removed and one or more rail ties 107 have been replaced. In the illustrated embodiment, the machine 100 includes a frame 109 that travels along the rails 111 on wheels 113.

A collector 115 disposed on either side of the machine 100 collects tie plates 103 from the rail bed 105 as the machine 100 moves along the rails 111. The collected tie plates 103 are provided to a conveyor system 117, which in the illustrated embodiment includes two transverse conveyors 119 that carry tie plates 103 from the collectors 115 toward a longitudinal conveyor 121. The direction of motion of tie plates 103 along the conveyor system 117 is denoted by arrows although it can be appreciated that other types of conveyors may be used. Alternatively, other devices or systems may be employed for the transfer of tie plates 103 from one location of the machine 100 to another. In the embodiment illustrated in FIG. 1, each transverse conveyor 119 includes a rotating belt that carries tie plates 103 lying flat on the belt. The tie plates 103 are carried toward the centerline 123 of the machine 100, where tie plates 103 from both transverse conveyors 119 are dropped onto the longitudinal conveyor 121. The longitudinal conveyor 121 includes a moving chain or another member moving within a channel in an endless fashion. Tie plates 103 deposited onto the longitudinal conveyor 121 are dropped into the channel such that they travel along the longitudinal conveyor on their edge, as shown in FIG. 1. An optional ledge (not shown) may be arranged at a height above the longitudinal conveyor 121 that is sufficient to permit passage of a tie plate 103 standing on its long edge to pass thereunder, and which contacts those tie plates 103 standing on their short edges, causing them to tip onto one of their long edges while on the longitudinal conveyor 121 as they pass under the ledge and to continue travelling along the longitudinal conveyor 121. This on-edge orientation of the plates 103 advantageously provides the plates 103 in one of four possible orientations as they travel along the longitudinal conveyor 121.

In the illustrated embodiment, tie plates 103 are delivered to a sensing portion 125 disposed around at least a portion of the conveyor system 117 as they travel along the longitudinal conveyor 121. In alternate embodiments, the tie plates 103 may pass through the sensing portion 125 by different means, for example, by sliding along an inclined surface.

Figure 3:
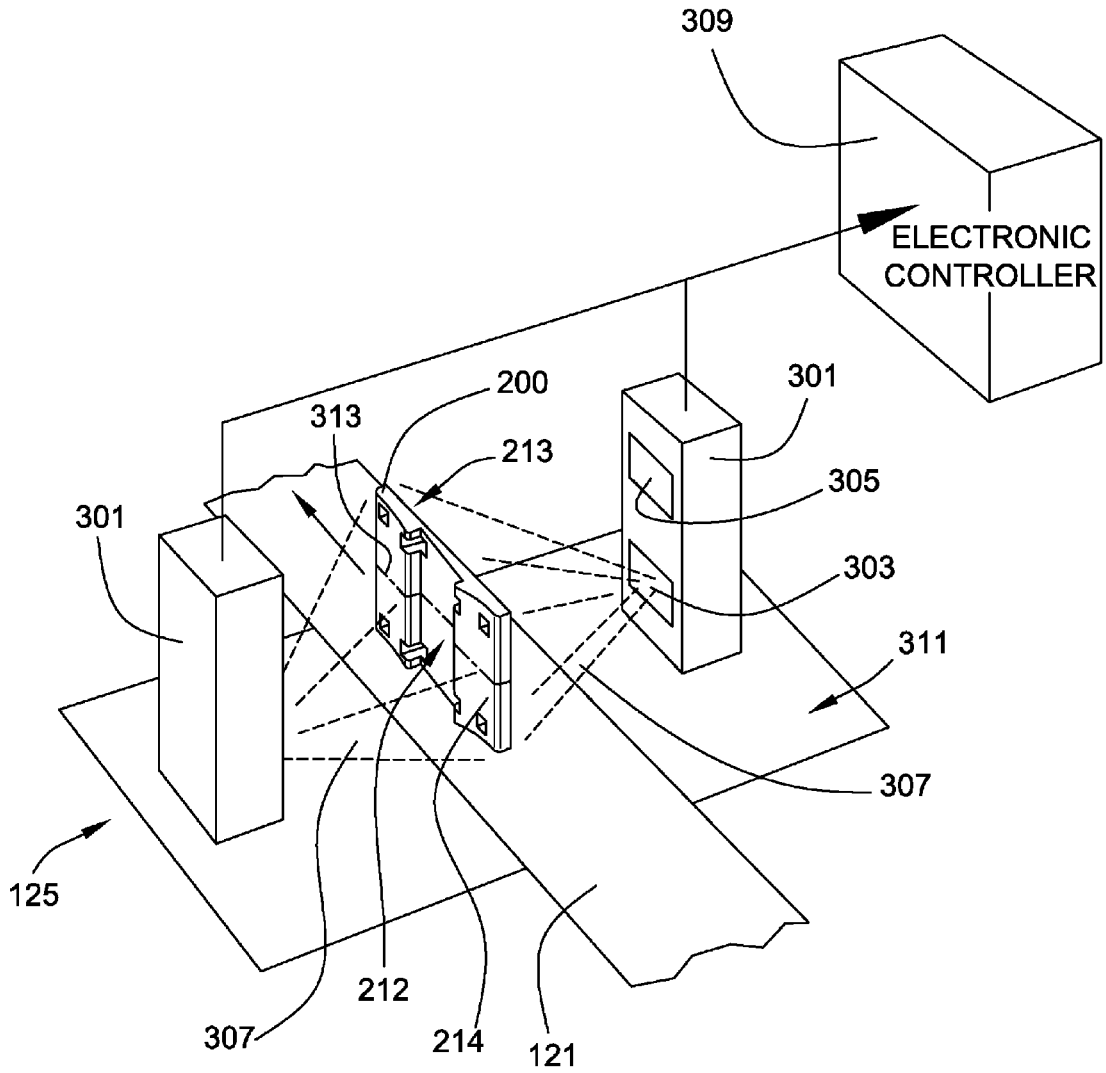
FIG. 3 is a partial outline view in perspective of a sensor arrangement in accordance with the disclosure.
Figure 4:
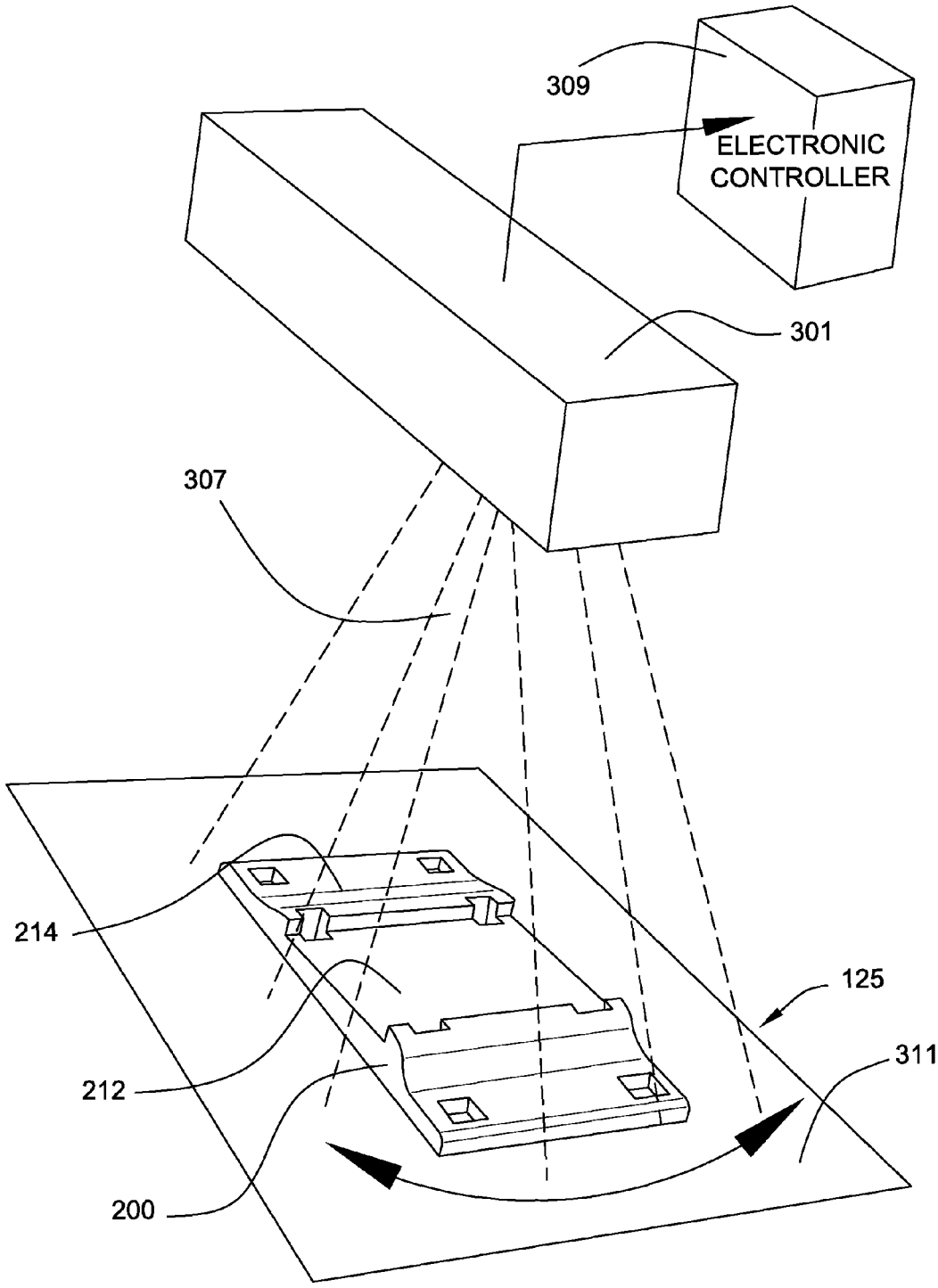
FIG. 4 is a partial outline view in perspective of an alternate sensor arrangement in accordance with the disclosure.

The sensing portion 125, two embodiments of which are described in more detail relative to FIGS. 3 and 4 that follow, includes one or more sensors 127 which may scan each tie plate 103 passing therethrough to determine the location, orientation, and/or size of its physical features as well as to determine its overall dimension and shape, for example, for quality control purposes. The scanned physical parameters of each tie plate 103 are communicated to an electronic controller (as shown, for example, in FIG. 3 or FIG. 4), which is integrated with or generally associated with the machine 100, before each tie plate is delivered to a plate sorting and orientation portion 129 of the machine 100.

The plate sorting and orientation portion 129 includes actuators 131 that can appropriately orient the tie plates 103 for delivery to one of two tie plate depositors 133 of the machine 100. The tie plate depositors 133 may include a magazine or collector that can receive properly-oriented tie plates 103 for placement under the rails 111 by any known device, for example, the actuator arms and associated structure disclosed in the '455 patent. The actuators 131 may operate in response to commands from the electronic controller that is in communication with the sensors 127, such that each tie plate 103 may be uniquely manipulated to achieve a specific orientation before entering into each tie plate depositor 133. The actuators 131 may perform additional functions, such as distributing tie plates 103 to the right or left side of the machine 100, as required, reject plates found to be defective, and so forth. As illustrated, the machine 100 may further include other structures, for example, a rail lifting structure 135 for lifting the rails 111 away from the ties 107 during insertion of tie plates 103, an operator cabin 137, an engine, and others.

Figure 2:
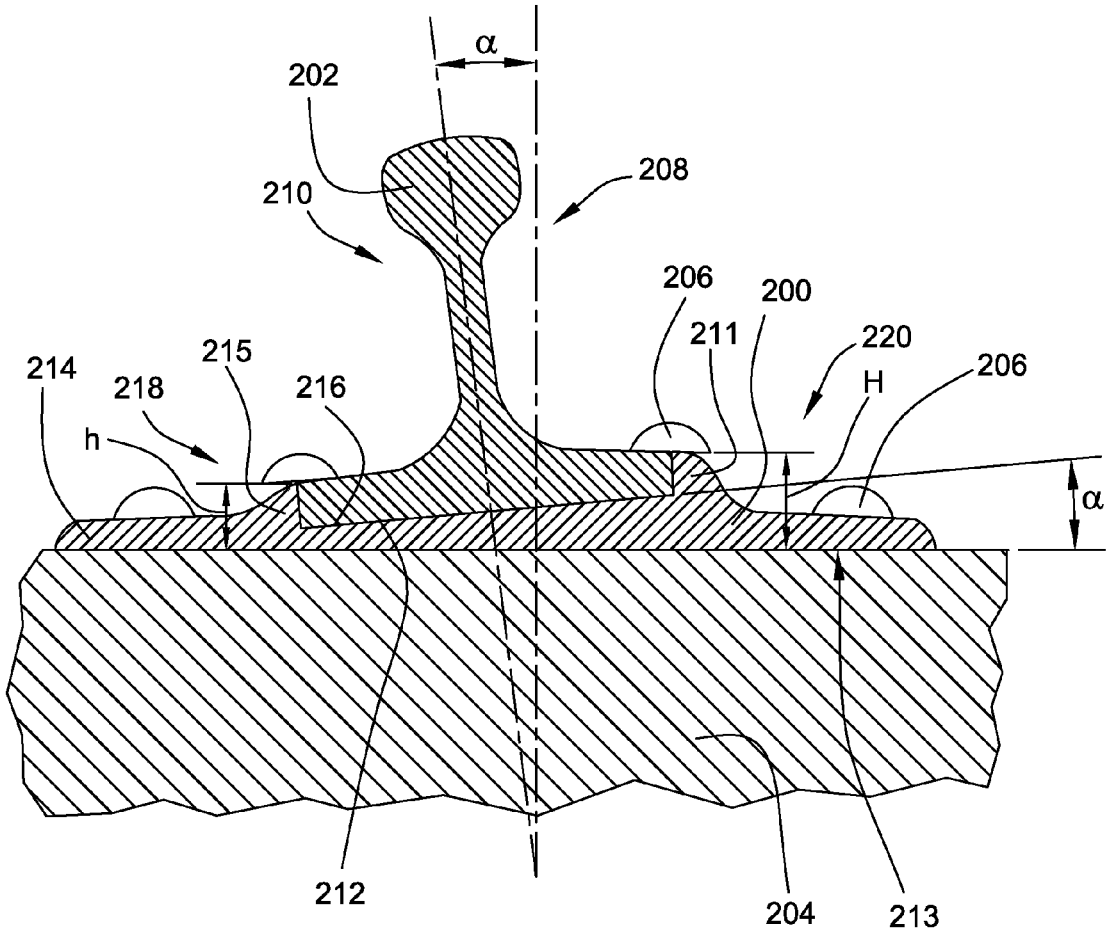
FIG. 2 is a cross section of a rail connected to a tie with a plate.

Certain types of tie plates, especially those used in modern railroad tracks that are suitable for high speed rail traffic, are asymmetrical and require installation in a specific orientation. A cross section of a typical tie plate 200 installed between a rail 202 and a rail tie 204 is shown in FIG. 2. The rail tie 204 may be made of wood, concrete, or any other suitable material, and has the tie plate 200 fastened thereon by fasteners 206. Although spikes are shown as the fasteners 206, other types of fasteners may be used, such as bolts, resiliently compressed elements, and so forth. The cross section shown in FIG. 2 corresponds to a rail disposed on the right side of the railroad track, i.e., a rail having its field side 208 on the right side of the drawing and its gage side 210 on the left side of the drawing. As is known, certain modern railway rails may be disposed at an angle toward one another across opposite sides of the railroad track, such that a camber is provided that aids in stabilizing rolling equipment. The camber angle, $\alpha$, is shown exaggerated in FIG. 2 and can be between about 1:40 (1.43 deg.) and 1:20 (2.86 deg.) depending on the railroad track. The camber angle $\alpha$ can be accomplished by placing the rail 202 onto a rail seat portion 212 of the tie plate 200.

As is more particularly shown in FIG. 2, the tie plate 200 has a generally flat tie surface 213 in contact with the rail tie 204. The generally flat tie surface 213 may further include integrated spikes (not shown) or other features that engage the rail tie 204. The rail seat portion 212 is generally flat and disposed at the angle $\alpha$ relative to the top surface of the rail tie 204 and the flat tie surface 213 of the tie plate 200. The rail seat portion 212 is flanked on either side by flange portions 214 that form openings (not shown) to accommodate the fasteners 206. The flange portions 214 are separated from the rail seat portion 212 by a field-side shoulder 211 and a gage-side shoulder 215.

The rail seat portion 212 is part of a channel that accommodates the base 216 of the rail 202. When the rail 202 is disposed within the channel on the rail seat portion 212 of the tie plate 200, the rail 202 is inclined at the camber angle α relative to vertical. As can be appreciated, the rail seat portion 212 requires the tie plate 200 to be installed at a unique orientation when positioned onto the rail tie 204. Hence, the tie plate 200 itself has a gage side 218 and a field side 220 as dictated by desired positioning of the rail seat portion 212 on one side of the rail tie 204 or the other. This asymmetry of the tie plate 200 is taken under consideration when orienting tie plates that are collected from the rail bed or are provided to a tie plate placing machine in bulk and enter the machine in random orientations. As can be seen in FIG. 2, the field-side shoulder 211 extends to a height, H, relative to the generally flat tie surface 213, while the gage-side shoulder 215 extends to a lower height, h. In other words, in the illustrated example of the tie plate 200, the height of the plate at the field-side shoulder 211 is greater than that at the gage-side shoulder 215.

A partial outline view of the sensing portion 125 (FIG. 1) of the machine 100 is shown in FIG. 3. In the illustrated embodiment, elements or features previously described relative to FIG. 1 or FIG. 2 are denoted with the same reference numerals as previously used for simplicity. The sensing portion 125 of the illustrated embodiment includes two optical sensors 301. Each optical sensor 301 includes emitter and receiver portions, respectively, 303 and 305, which are capable of emitting optical or electromagnetic beams, denoted generally as 307, from their respective emitters 303. The beams reflect and/or refract when they contact a surface of an object, and return to the receiver portion 305 of each sensor 301. The sensor 301 receives and interprets the signals received, and provides a signal to an electronic controller. The beams 307 may include one or more focused transmissions, and may further include a single beam of energy that is swept along a line, essentially "painting" a line 313 on the object. The line 313, as shown, extends along a major longitudinal dimension of each tie plate 200, which advantageously enables the painting of the line 313 across the rail seat portion 212 of the plate 200 and which, as is discussed in further detail below, enables a vision system to discern the direction of the cant thereof.

In an alternate embodiment, the sensors 301 may include a visual image acquisition device, such as a digital camera or, in general, a charge coupled device (CCD) image sensor or complementary metal oxide semiconductor (CMOS) technology to capture visual representations or pictures of the tie plate in a digital format. This digital image of the tie plate may be stored in an appropriate memory device and used in subsequent operations as described below.

In the embodiment illustrated in FIG. 3, two sensors 301 are disposed on opposite sides of a sensing region 311. A tie plate 200 (FIG. 2), for example, is conveyed through the sensing region 311 by the longitudinal conveyor 121 (FIG. 1) although other types of conveyors may be used. While moving through the sensing region 311, the tie plate 200 stands on one of its long edges, as shown, and each side of it is scanned by beams 307 emanating from the sensors 301. As shown, the flat tie surface 213 (FIG. 2) of the tie plate 200 is scanned by the sensor 301 disposed on one side of the sensing region 311, and the side of the tie plate 200 having the two flange portions 214 surrounding the rail seat portion 212 is scanned by the second sensor 301 that is disposed on the other side of the sensing region 311. As can be appreciated, due to the manipulation of the tie plate 200 by the conveyor system 117, which carries plates along the longitudinal conveyor 121 on their long edges, the tie plate 200 can enter the sensing region 311 in one of four possible orientations.

Together, the two sensors 301 are arranged to sense the contour of each side of the tie plate 200 along the lines 313 "painted" by the beams 307 or, alternatively or in addition thereto, based on visual data or pictures of the tie plate acquired from the sensors 301. In the illustrated embodiment, the beams 307 emanating from the emitters 303 are arranged to impinge onto the surface of the plate 200 at an angle relative to the receiver portions 305 such that a clear view of the painted line on the surface of the plate 200 is provided for the receiver portion 305 of each sensor 301. In the illustrated embodiment, the beams 307 impinge perpendicularly onto the plate 200 to provide the painted line 313, which is then viewed and captured by each receiver portion 305. Visual acquisition of the painted line 313 is analyzed to provide a set of points from each side of the plate 200 for further processing. In regard to the bottom side of the plate, points on the contour are collinear so a subset of all visible points may be selected. However, points on the rail side contour of the plate may be selected to illustrate various areas of interest of the plate, such as the locations of the edges of the plate, the peaks of the shoulders surrounding the rail seat portion of the plate, and so forth.

The contour information gleamed from the tie plate 200 is provided to the electronic controller 309. In addition to the contour information, other information about the tie plate 200 may be acquired from the signals provided by the sensors 301. For example, the length or total dimension of the tie plate 200 may be determined. Further, the thickness of the tie plate 200 at the various portions thereof may be calculated by comparing the signals provided by the two sensors 301. In one embodiment, the beams 307 may sweep the entire surface on either side of the tie plate 200 by sweeping the beams 307 vertically along the height of the tie plate 200 as it passes through the sensing region 311. Such sensor operation may provide additional information about the tie plate 200, such as the presence of foreign matter on the tie plate 200, the planarity of the various portions thereof, the presence of bent portions or chipped-off corners, the surface finish as an indication of corrosion of the tie plate 200, the presence of cracks, and/or any other quality-related aspect of the tie plate 200 as an indication of suitability for its use or reuse. Use of the sensing systems described herein, as well as other types of sensors, advantageously possesses adequate resolution to adequately discern subtle features of the tie plate, such as the angle of the rail seat portion, which can be as little as 1.43 degrees (see, for example, discussion relative to FIG. 2).

A partial outline view of an alternative embodiment of a sensor arrangement in the sensing portion 125 (FIG. 1) of the machine 100 is shown in FIG. 4. Elements or features previously described are denoted with the same reference numerals as previously used for simplicity. The sensing portion 125 of the illustrated embodiment includes a single optical sensor 301 disposed above the tie plate 200 as it passes through the sensing region 311. In this embodiment, the tie plate 200 lies flat on one of its major faces as it passes under the sensor 301 such that its rail-facing portion, which includes the flange and rail seat portions 214 and 212, may be scanned by beams 307 emanating from the sensor 301. Because the top to bottom orientation of the tie plate 200 may not be controlled before the tie plate 200 enters the sensing region 311, the sensing region 311 may be capable of rotation or another type of motion that can move the tie plate 200 in more than one directions while it is scanned by the sensor 301 to provide an indication of the presence and/or location of canted or asymmetrical features in the tie plate 200. Alternatively, a second sensor (not shown) that is similar to the sensor 301 may be located beneath the sensing region 311 such that both sides of the plate may be scanned. As in the embodiment described relative to FIG. 3, a signal from the sensor 301 or multiple sensors may be provided to the electronic controller 309.

Figure 5:
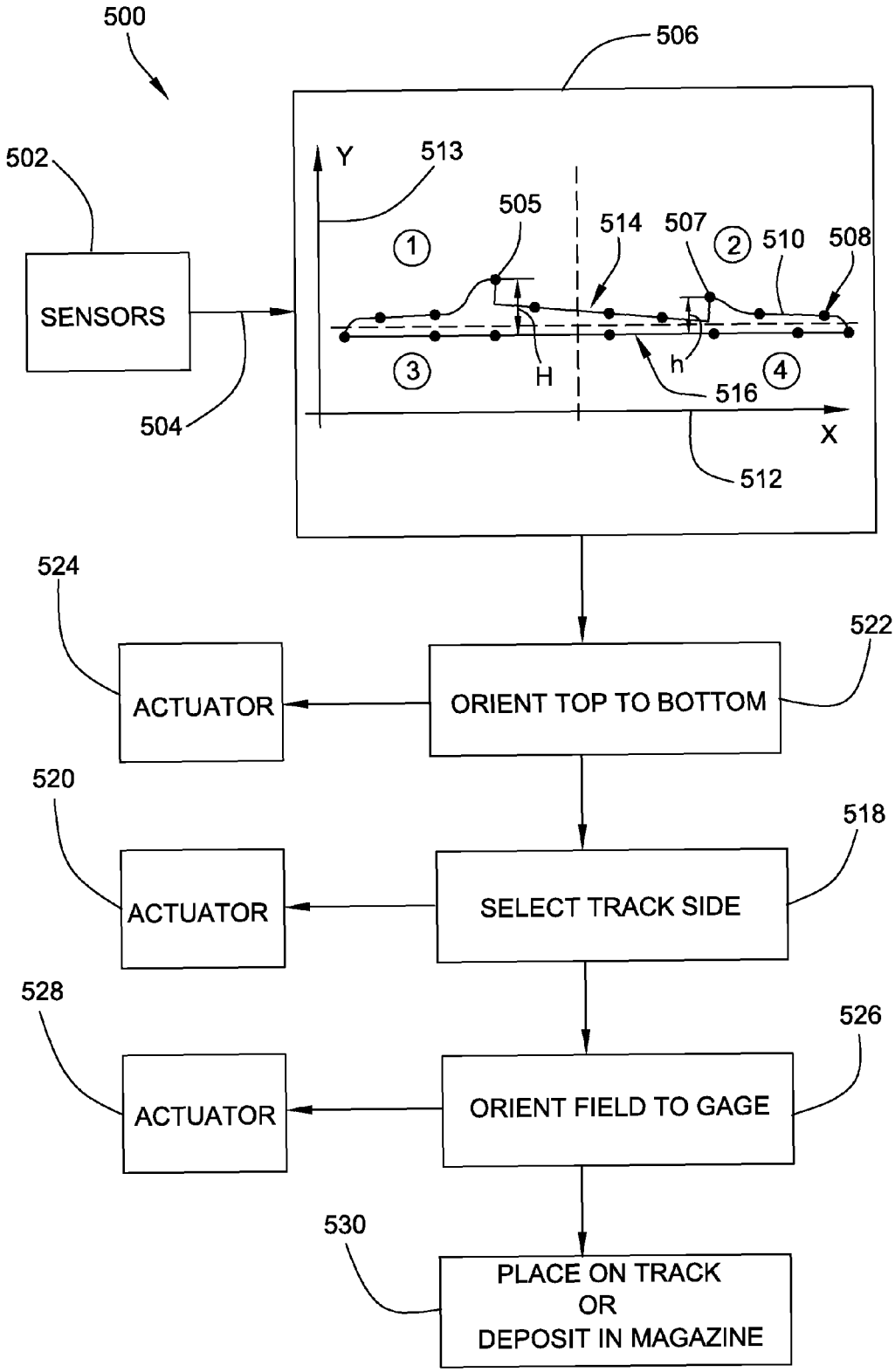
FIG. 5 is a block diagram of a tie plate sorting system in accordance with the disclosure.

A block diagram for one embodiment of a control system 500 used to determine the orientation of tie plates based on sensor input is shown in FIG. 5. The control system 500 may be appropriately coded and operating within an electronic controller, for example, the electronic controller 309 (FIG. 3), or any other appropriate electronic device. The electronic controller may be a single controller or may include more than one controller disposed to control various functions and/or features of a machine. For example, a master controller, used to control the overall operation and function of the machine, may be cooperatively implemented with a motor or engine controller, used to control the engine and/or other systems of the machine. In this embodiment, the term "controller" is meant to include one, two, or more controllers that may be associated with the machine 100 and that may cooperate in controlling various functions and operations of the machine 100 (FIG. 1). The functionality of the controller, while shown conceptually in FIG. 5 to include various discrete functions for illustrative purposes only, may be implemented in hardware and/or software without regard to the discrete functionality shown. Accordingly, various interfaces of the controller are described relative to components of the control system 500 shown in the block diagram of FIG. 5. Such interfaces are not intended to limit the type and number of components that are connected, nor the number of controllers that are described.

In the illustrated embodiment, the control system 500 is operably connected to and arranged to receive information from one or more sensors 502, for example, the sensors 301 shown in FIG. 3 or 4. The sensor(s) 502 provide sensor signals 504 to a plate orientation determinator 506. The sensor signals 504 may be any type of digital or analog information that is indicative of the shape, position, and/or size of geometrical features of an object, for example, the tie plate 200 (as shown in FIG. 3 or 4). The plate orientation determinator 506 may include any number or type of subroutines that are arranged to characterize, analyze, and/or evaluate the size, position, orientation, and/or quality of the object sensed by the sensors 502 based on the sensor signals 504. For example, the plate orientation determinator 506 may include a database of known or acceptable tie plate types. The acceptable tie plate types may include various models or designs of plates having different overall size, thickness, or other physical characteristics. The plate orientation determinator 506 may use certain sensor signals 504, such as the overall length or size of a plate, to determine the type of plate being sensed, and to retrieve information from the database that is relevant to that particular plate type.

In the illustration of FIG. 5, the plate orientation determinator 506 is shown containing a graphical plate contour 510 for simplicity, although any other type of computational or graphical method of information processing is contemplated. In one embodiment, a contour of each side of the plate is interpolated based on two sets or pluralities of points 508, each set acquired on one side of the plate by the sensors 502. More particularly, in reference to FIG. 3, each sensor 301 may acquire a visual representation of the painted line 313 from each side of the plate 200. This visual representation may be reduced by the controller 309 into a plurality of points 508, which may include about three hundred discrete points, for each side of the plate 200. The set of points 508 that appear as being generally collinear is interpreted as belonging to the bottom, flat side of the plate. The other set of points 508, which are expected not to be collinear due to the various "bumps" or "shoulders" on the rail side of the plate, is interpreted as belonging to the top side of the plate. In this embodiment, the set of points acquired from the rail side of the plate is used to determine the field and gage side of the plate by performing distance measurements between the bottom side of the plate to the highest point or peak of the field-side shoulder 505 and of the gage-side shoulder 507 of the plate. The results of these distance measurements, which are shown as H and h in the figure in a fashion consistent with the illustration of FIG. 2, are two measured distances, the larger of which (H) being indicative of the field side of the plate, and the shorter of which (h) being indicative of the gage side of the plate.

Returning now to FIG. 5, a sensed plate contour 510 may be interpolated from the points 508, which although are acquired as two separate sets of points they are illustrated together as positioned along the contour 510. In FIG. 5, the sensed plate contour 510 is represented in the main portion of the graph defined by a horizontal X-axis 512 and a vertical Y-axis 513 for purpose of illustration. From this view, the collection of points 508 disposed on the rail seat portion 514 of the plate can be used to interpolate a straight line portion of the contour 510 that corresponds to the rail seat portion 514 such that the angle and direction of inclination of its camber can be determined. As previously discussed, the sensed plate contour 510 may appear in one of four possible configurations. That is, the plate 200 may enter the sensing region 311 (FIG. 3) with the rail side of the plate facing the sensor 301 disposed on the right or on the left side of the region 311, and with the field or gage side thereof leading or, correspondingly, trailing in reference to the direction of travel of the plate 200 into the sensing region 311.

Given the four possible orientations of plates entering the sensing region 311, the plate orientation determinator 506 considers the orientation of the sensed plate contour 510, which is compiled based on the information provided by the sensors 502, and assigns to each plate 200 an orientation designation in accordance with, for example, the information tabulated in Table 1 table, which is shown below, or a similar collection of information:

TABLE 1

| | Rail side of plate on the right side of the machine | Rail side of plate on the left side of the machine |
|---|---|---|
| Field side of the plate on the leading end of the plate | Plate orientation designation = 1 | Plate orientation designation = 2 |
| Gage side of the plate on the leading end of the plate | Plate orientation designation = 3 | Plate orientation designation = 4 |

For instance, in the orientation of the plate 200 shown entering the sensing region in FIG. 3, which has rail side of the plate on the right side of the machine 100 and the gage side of the plate on its leading end as it enters the sensing region 311, the assigned plate orientation designation would be selected as equal to "3."

The plate orientation determinator 506 may specifically determine the certain plate orientation operations that are required for each plate based on the predetermined orientation designation. For example, a plate having a designation orientation of "3" may be inverted if the plate is destined for installation on the right side of the machine as it travels along the track. This and other predetermined orientation operations can be accomplished by allowing the plate to proceed through the machine and by appropriately commanding one or more actuators to invert and/or rotate the plate in a single or in multiple successive operations before the plate is provided to portions of the machine performing its installation beneath the rail, for example, the plate depositors 133 (FIG. 1).

Following the determination of the specific plate orientation steps that should be performed at the plate orientation determinator 506, the control system 500 may optionally determine which side of the railroad track or which side of the machine 100 (FIG. 1) the plate should be supplied to at 518. The decision at 518 may simply include information on which side of the machine 100 the previous plate was directed to such that next plate is directed to the opposite side of the machine. Depending on the side of the machine selected, a command may be provided to an actuator 520 to cause the plate to be carried to the desired side of the machine. It is noted that depending on the configuration of a machine or process, the optional selection and subsequent command at 518 may be performed before, during, or after one or more plate orientation processes, as are described below. For example, the machine 100 shown in FIG. 1 may first perform a top-to-bottom orientation process for a plate before selecting a side of the track that the plate will be installed and subsequently perform a field-to-gage side orientation process.

A first orientation process 522 may adjust the top-to-bottom orientation of the plate. In other words, the first orientation process 522 may be activated when plate orientation determinator 506 determines that the sensed plate is inverted relative to an appropriate installation orientation. In these instances, the first orientation process 522 may command an inversion actuator 524 to invert the plate as the plate travels through a sorting system of the machine 100 (FIG. 1). In the embodiment shown in FIG. 1, the inversion actuator may be one of the actuators 131 that operates a table 139. The table 139 includes a segmented portion of the conveyor 121 and can rotate in either direction by, for example, 90 degrees, to appropriately orient a tie plate disposed thereon and direct it to either one of two transverse conveyors 141 that can deliver the plate to the plate depositors 133 on the right or left side of the machine 100.

Returning now to FIG. 5, a second orientation process 526 may adjust the field-to-gage side orientation of the plate by providing an appropriate command to a rotation actuator 528. As can be appreciated, activation of the second orientation process 526 may occur when the plate orientation determinator 506 determines that the sensed plate is reversed or rotated 180 relative to its desired installation orientation. In other words, the second orientation process 526 may be used to correct a field-side to gage-side disorientation of the plate. In the embodiment shown in FIG. 1, the rotation actuator may be one of the actuators 131 that operates a selectively magnetized plate retainer 143, which can rotate about an axis parallel to the centerline of the machine 100 to re-orient the plates 103 before they are dropped into the plate depositors 133.

After plate orientation is sensed and adjusted, the tie plates are delivered to one or more plate depositors, for example, the plate depositors 133, or may alternatively or additionally be loaded onto a magazine (not shown) at 530. Examples of depositors can be found in the '455 patent discussed above. Magazines for use with railroad tie plates are also known in the art.

INDUSTRIAL APPLICABILITY

The disclosure further provides a method for automatically sorting tie plates collected from the field during construction, repair, or maintenance of railroad tracks. The automation of the tie plate sorting process presents a considerable advancement of the current state of the art, which relies on manual sorting and operations. The current manual operations are time consuming, prone to operator error, and further place workers close to large equipment having numerous moving parts. All methods described herein can be performed in any suitable order unless otherwise indicated herein or otherwise clearly contradicted by context.

Figure 6:
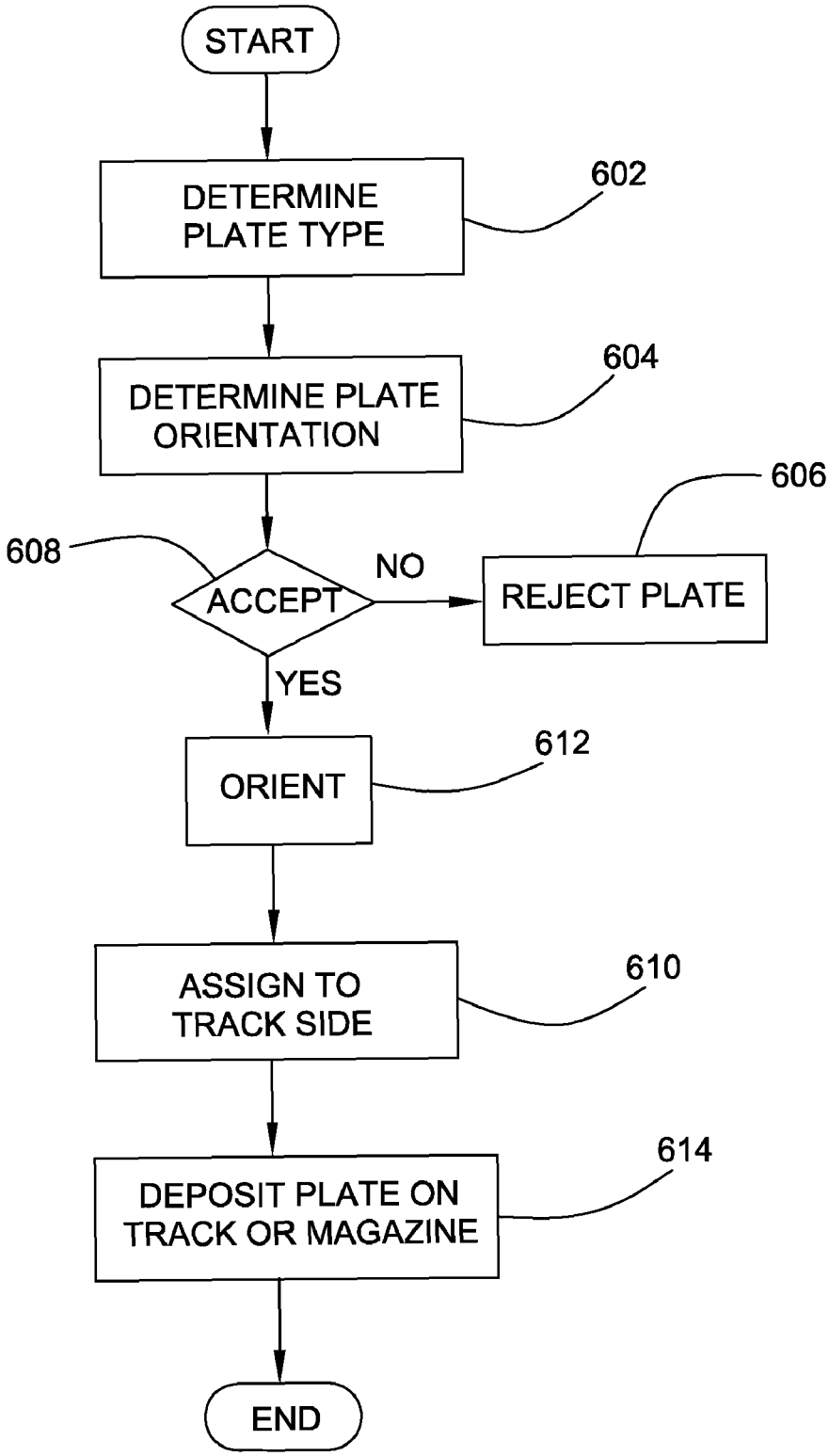
FIG. 6 is a flowchart for a method of sorting tie plates in accordance with the disclosure.

A flowchart for a method of sorting and adjusting the orientation of tie plates is shown in FIG. 6. The type of tie plate may be determined at 602. To this end, a device, for example, the machine 100 (FIG. 1) including one or more sensors, may scan or acquire a visual representation of at least portions of the tie plate. Information provided by the sensors may be analyzed in an electronic controller to provide dimensional and other information about the particular tie plate being scanned. In the determination of tie plate type at 602, for example, the overall dimensions and features, such as rail seat portions of the tie plate accommodating rails, may be used to categorize or classify the particular tie plate as being a particular type of tie plate.

The classification of tie plates can be used to sort tie plates as they are collected from the field, and to reject incorrect-type tie plates that may be accidentally mixed in with the proper type of tie plate for a certain application and/or reject other metallic debris that may have been collected, such that the tie plate installation process is not needlessly delayed. Moreover, the system may detect bent or damaged tie plates and reject them before they enter a supply stream of plates provided to tie plate depositors on a machine, such as those shown in FIG. 1, or others.

The visually acquired and/or otherwise sensed physical dimensions and attributes of each individual tie plate collected from the field may be further used to determine the orientation of each tie plate at 604. The orientation determination may occur before, after, or concurrently with the determination of the tie plate type at 602. Although the orientation of a tie plate may be adjusted to a desired orientation for placement on a railroad track, defective tie plates and/or debris collected from the rail bed, such as spikes, other metallic components, and so forth, are rejected at 606 following an evaluation or decision at 608. The decision to accept or reject a tie plate or other objects being scanned may be based on a comparison of one or more physical attributes of the object being scanned, such as a digital photograph, a measurement of length or thickness of the object, the presence or absence of a particular feature, such as a slanted rail seat surface, and so forth, with a predetermined feature or aspect that is stored in an appropriate form at within an electronic controller.

Following successful acceptance of a tie plate at 608, the tie plate may be assigned to a track side of a tie plate depositor machine at 610 before or after the tie plate undergoes a re-orientation process at 612. Having determined the orientation of a tie plate at 604, and considering that asymmetrical tie plates may be used on either side of the track of a railroad, it can be appreciated that a reversal and/or rotation of a tie plate may be required before it is provided to a tie plate depositor device or placed in a stack or magazine for later deposition. The assignment to a track side 610 may be selectively made based on the requirements of a depositor operation. Alternatively, the assignment to a track side at 619 may be made based on the orientation of a particular tie plate as it is collected from the field. This alternate embodiment may advantageously increase the speed of the machine by eliminating at least one re-orientation operation of the plate when applicable. Orientation of a tie plate may include one or more active re-orientation operations performed to change the top-to-bottom or field-to-gage side orientation of a tie plate.

After each tie plate has been successively scanned, sorted, and/or properly oriented, it is delivered to a tie plate depositor portion of a machine, for example, the tie plate depositor 133 (FIG. 1), or stacked with other oriented tie plates, for example, in a magazine for later use, at 614.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

We claim:

1. A machine for automatically orienting railroad tie plates, comprising:

a sensing region;

at least one optical sensor associated with the sensing region and connected to the machine, the at least one optical sensor including a transmitter portion arranged to transmit a sensing beam such that the sensing beam at least one of reflects and refracts at an angle from a surface of a tie plate and a receiver portion arranged to receive a visible representation of the sensing beam that at least one of reflects and refracts at the angle such that a physical feature of the tie plate is discernible, wherein the at least one optical sensor is adapted to sense the physical feature of the tie plate;

an electronic controller operably connected to the at least one optical sensor and disposed to receive therefrom a sensor signal indicative of the physical feature of the tie plate when the tie plate is in the sensing region;

wherein the electronic controller is further disposed to:

determine an orientation of the tie plate based on the sensor signal;

compare the orientation of the tie plate with a predetermined orientation; and provide a command to at least one actuator adapted to perform at least one tie plate orientation operation to change the orientation of the tie plate based on the comparison of the orientation of the plate with the predetermined orientation.

2. The machine of claim 1, further comprising a conveyor system adapted to transport at least one tie plate from one location of the machine to another, wherein at least a portion of the conveyor system traverses a portion of the sensing region.

3. The machine of claim 2, wherein the conveyor system is arranged to carry the at least one tie plate while the at least one tie plate is standing on an edge thereof such that each of a bottom side and a top side of the at least one tie plate is visible to the at least one optical sensor and, further, such that the at least one tie plate arrives at the sensing region in one of four possible orientations.

4. The machine of claim 3, wherein each plate has a generally rectangular shape having two short edges and two long edges, and wherein the conveyor system is arranged to carry the at least one tie plate while the same is standing on one of its two long edges such that the at least one optical sensor is disposed to sense a contour of the at least one tie plate that is disposed longitudinally along the at least one tie plate between the two long edges.

5. The machine of claim 1, further including an additional optical sensor disposed adjacent the sensing region and arranged to scan a first side of the at least one tie plate as it passes through the sensing region, wherein the at least one optical sensor is arranged to scan a second side of the at least one tie plate, and wherein the additional optical sensor is arranged opposite the at least one optical sensor.

6. The machine of claim 1, wherein the tie plate has a bottom side and a top side that includes two shoulders, wherein the signal comprises information about at least one set of points disposed along a contour of the tie plate, and wherein determining an orientation of the tie plate based on the sensor signal in the electronic controller is accomplished by one of:

inspecting each of the plurality of points and determining that the contour of the tie plate represents the bottom side when the points are collinear; and inspecting each of the plurality of points and determining that the contour of the tie plate represents the top side when the points are not collinear.

7. The machine of claim 6, wherein determining an orientation of the tie plate based on the sensor signal in the electronic controller further includes:

identifying the two shoulders on the top side of each tie plate;

measuring a first tie plate height at one of the two shoulders;

measuring a second tie plate height at an other of the two shoulders; and determining a field side of the tie plate based on the larger of the first and second tie plate heights.

8. The machine of claim 1, wherein the at least one optical sensor is arranged to capture a digital image of at least a portion of the at least one tie plate, and wherein the at least one optical sensor is arranged to provide to the electronic controller a signal indicative of the digital image.

9. The machine of claim 1, wherein the electronic controller is further disposed to determine at least one physical dimension of the tie plate, compare the at least one physical dimension with a predetermined value, and determine the orientation of the tie plate based on the at least one physical dimension.

10. The machine of claim 1, wherein the at least one tie plate orientation operation is an operation inverting an orientation of the tie plate, and wherein the electronic controller is further disposed to provide an additional command to an additional actuator adapted to perform a second tie plate orientation operation that reverses the orientation of the tie plate.

11. The machine of claim 1, wherein the at least one optical sensor emits a laser beam that oscillates relative to the tie plate such that it paints a line across a portion of the tie plate to provide information that is indicative of an angle of a rail seat portion of the tie plate.

12. A method for automatically sorting and orienting tie plates in a tie plate placing machine, comprising:

sensing at least one physical feature of each tie plate by scanning a portion thereof with an optical sensor;

providing a signal indicative of a physical feature from the optical sensor to an electronic controller;

determining an orientation of each tie plate in the electronic controller based on the signal;

comparing the orientation of each tie plate with at least four predetermined orientations;

assigning an orientation designation to each tie plate based on the comparison between the orientation of each tie plate with the predetermined orientations; and re-orienting each tie plate based on the orientation designation.

13. The method of claim 12, wherein each tie plate has a top side and a bottom side, wherein both the top and bottom sides of each tie plate are scanned by the optical sensor and an additional optical sensor.

14. The method of claim 13, wherein each tie plate has a generally rectangular shape having two short edges and two long edges, and wherein the method further includes carrying each tie plate standing on one of its two long edges between the optical sensor and the additional optical sensor such that each of the top and bottom sides of each tie plate is visible by one of the optical sensor and the additional optical sensor.

15. The method of claim 12, wherein the optical sensor emits a sensing beam that paints a line along a longitudinally extending contour of each tie plate.

16. The method of claim 12, wherein the signal provided from the optical sensor to an electronic controller includes information indicative of a position of a plurality of points disposed on a contour of each tie plate.

17. The method of claim 16, wherein determining the orientation of each tie plate includes one of:

inspecting each of the plurality of points and determining that the contour of the tie plate represents the bottom side when the points are collinear; and inspecting each of the plurality of points and determining that the contour of the tie plate represents the top side when the points are not collinear.

18. The method of claim 17, wherein determining the orientation of each tie plate further includes:

identifying two shoulders on the top side of each tie plate;

measuring a first tie plate height at one of the two shoulders;

measuring a second tie plate height at an other of the two shoulders; and determining a field side of the tie plate based on the larger of the first and second tie plate heights.

* * * * *